US005131110A

United States Patent [19]

Hadgis

[11] Patent Number: 5,131,110

[45] Date of Patent: Jul. 21, 1992

[54] METAL POLISHING MACHINE

[75] Inventor: John S. Hadgis, Hinckley, Ohio

[73] Assignee: Areway, Inc., Brooklyn, Ohio

[21] Appl. No.: 719,968

[22] Filed: Jun. 24, 1991

[51] Int. Cl.[5] ..... A46B 13/02; B24B 41/06

[52] U.S. Cl. ..... 15/88.3; 15/97.1; 15/268; 51/105 R; 51/310

[58] Field of Search ..... 15/88.1–88.4, 15/97.1, 268; 51/216 R, 216 T, 227 R, 236, 237 R, 237 T, 274, 98 R, 105 R, 105 SP, 131.1, 310

[56] References Cited

U.S. PATENT DOCUMENTS 2,893,027 7/1959 Cresswell ..... 15/88.3

2,986,849 6/1961 Clark ..... 15/88.3

*Primary Examiner*—Edward L. Roberts

*Attorney, Agent, or Firm*—Renner, Otto, Boisselle & Sklar

[57] ABSTRACT

A metal polishing machine includes a rotary wire brush and a fixture for supporting a workpiece during the polishing operation. Also supported on the fixture are a plurality of ring mounted filler pins which extend into apertures in the workpiece and terminate at a surface of the workpiece to be polished. The pins prevent the brush from scouring or otherwise damaging the edges of the apertures during the polishing operation.

18 Claims, 2 Drawing Sheets

METAL POLISHING MACHINE

BACKGROUND OF THE INVENTION

This invention relates to a metal polishing machine for polishing vehicle wheels and other workpieces, such machine including a plurality of filler plugs or pins that fit into holes in the workpiece to prevent a polishing brush from scouring or otherwise damaging the edges of the holes during the polishing operation.

Wheel and other workpiece polishing machines are generally known. However, there is a need for a machine that will prevent the polishing brush from scouring or otherwise damaging the edges of holes in the surface of the workpiece being polished.

SUMMARY OF THE INVENTION

The present invention provides a metal polishing machine that can safely be used to polish vehicle wheels and other workpieces having apertures in the surfaces being polished without scouring or otherwise damaging the periphery of the apertures.

In accordance with one aspect of the invention, the machine includes a series of filler plugs or pins that fit into holes in the workpiece surface being polished to prevent the polishing brush from scouring or otherwise damaging the edges of the holes during the polishing operation.

In accordance with another aspect of the invention, the relative positions of the workpiece and filler plugs or pins may be adjusted to locate the outer ends of the pins flush with the surface of the workpiece being polished surrounding the holes.

In accordance with a further aspect of the invention, as the filler plugs or pins wear during successive polishing operations, the relative positions of the workpiece and pins may be adjusted to compensate for such wear.

In accordance with yet another aspect of the invention, the filler plugs or pins are mounted on one or more concentric rings supported by the workpiece mounting fixture.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings.

DETAILED DESCRIPTION OF THE PREFERRED EMBODIMENT

Figure 1:
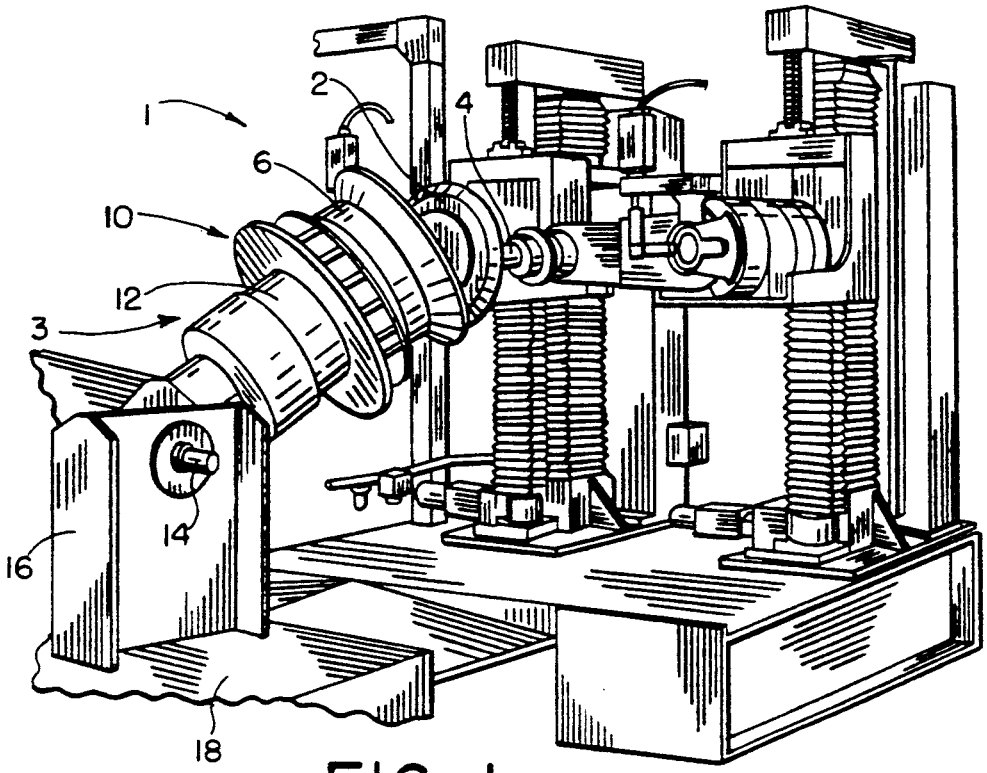
FIG. 1 is a perspective schematic illustration of a metal polishing machine incorporating the filler plugs or pins of the present invention.
Figure 2:
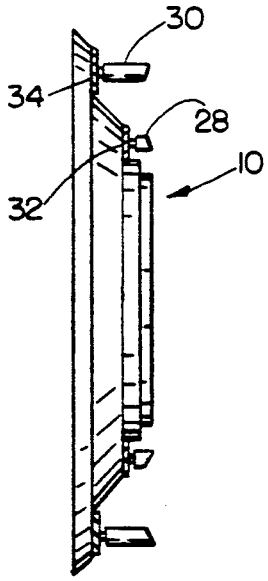
FIG. 2 is a fragmentary side view of the workpiece mounting support fixture portion of the metal polishing machine of FIG. 1 showing concentric rings with the pins mounted thereon.

Referring now in detail to the drawings, and initially to FIG. 1, a metal polishing machine embodying the present invention is generally indicated by reference numeral 1 and includes one or more motor powered rotating wire brushes 2 and associated workpiece mounting assemblies 3. Each wire brush 2 is supported by an arbor 4 which is adapted to be raised and lowered to engage the surface of the workpiece being polished.

In the illustration of FIG. 1, the workpiece is an large aluminum truck wheel 6 and the workpiece mounting assembly 3 includes a workpiece support fixture 10 adapted to support the wheel or other workpiece 6 during the polishing operation. The support fixture 10 is supported for both ratational movement by a motor driven shaft 12 and for pivotal movement about a pivot shaft 14 suitably positioned through frame member 16 mounted on structural base 18. By providing suitable automatic controls, the workpiece 6 may be automatically moved into engagement with the associated wire brush 2 at different angles as the brush moves up and down to polish the entire interior surface of the workpiece.

Figure 4:
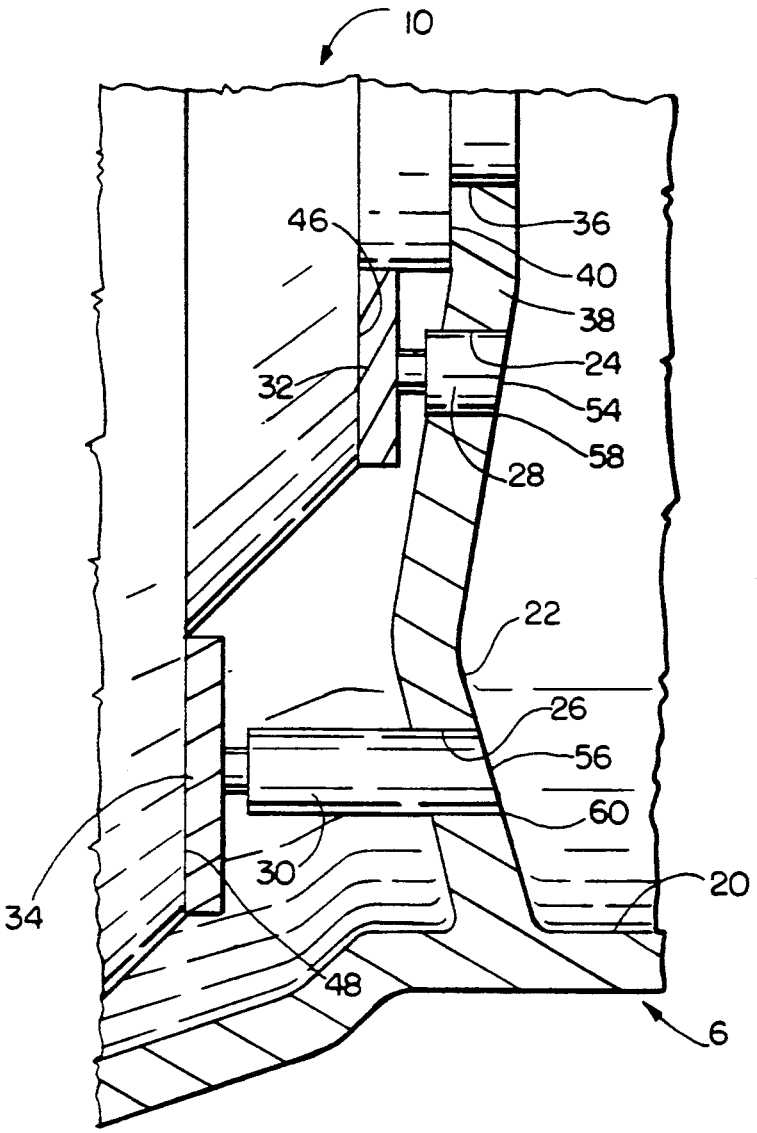
FIG. 4 is an enlarged fragmentary cross-sectional view through the pin support rings and wheel mounting support fixture of FIG. 3 with workpiece mounted thereon to show how the pins fit into holes in the workpiece.

The workpiece 6 is illustrated in FIG. 4 as having a relatively deep interior side wall 20 and sloping bottom wall 22 to be polished during the polishing operation. In the bottom wall 22 are one or more sets of circumferentially spaced decorative and/or mounting holes. Two sets of holes 24 and 26 are shown, one set of holes 24 being radially and axially offset from the other set of holes 26.

To prevent the wire brush 2 from scouring or otherwise damaging the periphery of the holes during the polishing operation, a plurality of filler plugs or pins 28 and 30, corresponding to the number of holes in the surface to be polished, are provided on the support fixture 10. These pins 28 and 30 may be of differing lengths and diameters or cross-sectional configuration to accommodate and fill holes 24 and 26 of different dimensions and locations.

Since the workpiece 6 illustrated by way of example but not by way of limitation includes two sets of axially and radially spaced holes 24 and 26, two sets of radially spaced pins 28 and 30 are provided, one set of pins 28 for filling the radially and axially innermost set of holes 24, and the other set of pins 30 for filling the radially and axially outermost set of holes 26. Each set of pins 28 and 30 is bolted or otherwise secured to a respective annular ring 32 and 34 of the required diameter for accurately locating the pins with respect to the holes in the workpiece when the rings 32 and 34 are suitably fastened to the support fixture 10. While two rings 32 and 34 are shown, any number of rings may be utilized for supporting differing patterns of pins 28 and 30 to match differing hole patterns 24 and 26 in the workpiece 6.

The workpiece 6 is concentrically oriented on the support fixture 10 by a central pilot surface 36 with the hub 38 of the workpiece supported by a work support platform 40 surrounding the pilot surface 36. Likewise, other suitable pilot surfaces 42 and 44 are provided on the support fixture 10 for concentrically orienting the respective pin rings 32 and 34 on respective support surfaces 46 and 48 on the support fixture. Suitable fasteners 50 (FIG. 3) may be provided for removably fastening the pin rings 32 and 34 to the respective support surfaces 46 and 48.

Figure 3:
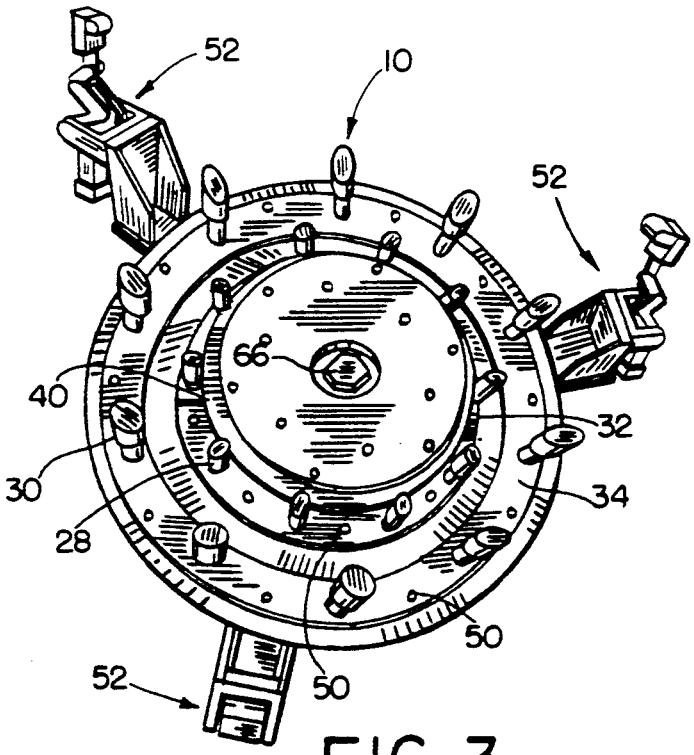
FIG. 3 is an enlarged perspective schematic illustration of the workpiece mounting support fixture and pin rings of FIG. 2.
Figure 5:
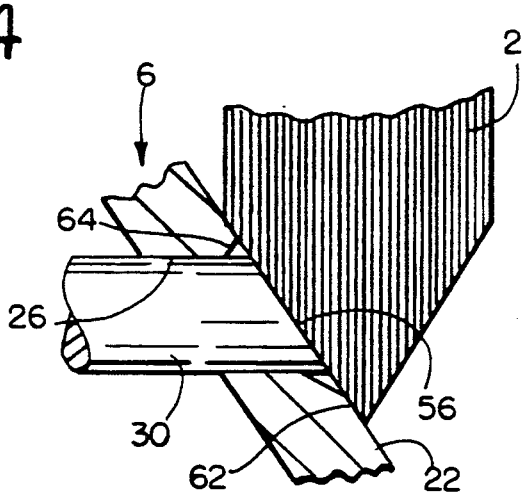
FIG. 5 is a further enlarged schematic illustration showing how one of the pins fills one of the holes in the workpiece to prevent a wire polishing brush from scouring or otherwise damaging the periphery of the hole.

As seen in FIGS. 4 and 5, when the workpiece 6 is positioned on the support structure 10 with the holes 24, 26 in the workpiece in alignment with the respective pins 28, 30 and the workpiece is clamped in place (using suitable clamps 52 such as shown in FIG. 3), the pins 28, 30 will substantially fill the holes 24, 26. Also, by properly controlling the length and positioning of the pins 28 and 30 with respect to the workpiece support surface 40, the end faces 54 and 56 of the pins can be made to be substantially in the same plane (i.e flush) as the end wall 22 surrounding the holes to prevent the brush 2 from scouring or otherwise damaging the edges 58 and 60 of the holes during polishing of the end wall.

In FIG. 5 wire brush bristles 62 are shown in contact with the end wall 22 of the workpiece 6. Also in the illustration in FIG. 5, it will be noted that the holes 26 in the workpiece 6 are countersunk at 64, but that nevertheless the outer ends 56 of the pins 30 are still substantially flush with the end wall 22 of the workpiece surrounding the holes 26.

During the initial set up, the outer ends 54 and 56 of the pins 28 and 30 can be brought into flush alignment with the end wall 22 of the workpiece 6 surrounding the holes 28 and 30 as by rotating a depth adjustment nut 66 (FIG. 3) at the center of the support fixture 10, which raises or lowers pin ring support surfaces 46 and 48 relative to the workpiece support platform 40. Likewise, as the pins 28 and 30 are worn during polishing of successive workpieces, the depth adjustment nut 66 can be rotated to further raise the pin ring support surfaces 46 and 48 relative tot he support platform 40 to keep the outer ends of the pins substantially flush with the end wall 22 of the workpiece. When the pins 28 and 30 are substantially worn out, the respective pin rings 32 and 34 may be removed from the support fixture 10 and the pins replaced as needed.

From the foregoing, it will be apparent that the metal polishing machine of the present invention includes filler plugs or pins which fit into holes in the workpiece to prevent the wire polishing brush from scouring or otherwise damaging the edges of the holes during the polishing operation. The filler pins are supported by rings for ease of assembly and removal from the support fixture. Both during the initial set up and as the pins wear, the height of the pin ring support surfaces may be adjusted relative tot he workpiece to position the outer ends of the pins substantially flush with the end wall of the workpiece surrounding the holes.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A fixture for supporting a workpiece during polishing of a surface of the workpiece, the surface having apertures therein, comprising workpiece support means for supporting the workpiece on said fixture, and filler means for filling the apertures in the surface of the workpiece while supported on said fixture to protect the edges of the apertures against scouring during polishing of the surface.

2. The fixture of claim 1 wherein said filler means have ends adapted to be positioned substantially flush with the surface of the workpiece surrounding the apertures therein.

3. The fixture of claim 2 further comprising means for adjusting the relative positions of the filler means and workpiece to position the ends of the filler means substantially flush with the surface of the workpiece surrounding the apertures.

4. The fixture of claim 1 further comprising ring means for supporting a plurality of said filler means, and means for locating said ring means on said fixture with said filler means in axial alignment with the apertures in the workpiece.

5. The fixture of claim 1 wherein said filler means comprises a plurality of pins, and means for supporting said pins on said fixture in axial alignment with the apertures in the workpiece.

6. The fixture of claim 5 wherein said means for supporting said pins comprises a ring.

7. The fixture of claim 6 further comprising means for adjusting the relative position of said ring and said workpiece support means on said fixuture such that said pins extend to the surface of the workpiece surrounding said apertures.

8. The fixture of claim 5 wherein said means for supporting said pins comprises a plurality of rings of different diameters, each of said rings having a plurality of said pins mounted thereon, and means for locating said rings on said fixture with said pins in axial alignment with respective apertures in the workpiece.

9. A metal polishing machine comprising a rotary polishing brush, and a support fixture for supporting a workpiece having a surface to be polished, the surface having openings therein, said fixture having filler means for filling said openings substantially flush with said surface during polishing of said surface by said brush.

10. The polishing machine of claim 9 wherein said filler means comprises pins adapted to be positioned on said fixture in axial alignment with said openings in said workpiece.

11. The polishing machine of claim 10 further comprising ring means for supporting said pins on said fixture.

12. The polishing machine of claim 11 wherein said ring means comprises a plurality of rings each supporting a plurality of said pins on said fixture.

13. The polishing machine of claim 12 further comprising means for supporting said rings in concentric relation on said fixture.

14. The polishing machine of claim 9 further comprising means for supporting said workpiece and said filler means on said fixture such that said filler means protrude into said openings and extend to the surface of the workpiece to be polished.

15. The polishing machine of claim 14 further comprising means for adjusting the relative positions of said filler mean sand said workpiece on said fixture to align the ends of said filler means with the surface of the workpiece surrounding the openings in which the filler means are received.

16. The polishing machine of claim 15 wherein said filler means comprise a plurality of pins, and ring means for supporting said pins on said fixture.

17. The polishing machine of claim 16 further comprising means for locating said ring means on said fixture with said pins in axial alignment with respective openings in said workpiece.

18. The polishing machine of claim 16 wherein said ring means comprises a plurality of rings each supporting a plurality of said pins on said fixture, said rings being removably attached to said fixture to permit removal and replacement of said pins.

* * * * *